US010538831B2

(12) United States Patent
Yamashita et al.

(10) Patent No.: US 10,538,831 B2
(45) Date of Patent: Jan. 21, 2020

(54) AGE-HARDENING STEEL FOR COLD FORGING USE

(71) Applicant: NIPPON STEEL & SUMITOMO METAL CORPORATION, Tokyo (JP)

(72) Inventors: Tomohiro Yamashita, Tokyo (JP); Yutaka Neishi, Tokyo (JP); Hitoshi Matsumoto, Tokyo (JP); Makoto Egashira, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 122 days.

(21) Appl. No.: 15/560,451

(22) PCT Filed: Mar. 30, 2016

(86) PCT No.: PCT/JP2016/060524
§ 371 (c)(1),
(2) Date: Sep. 21, 2017

(87) PCT Pub. No.: WO2016/159158
PCT Pub. Date: Oct. 6, 2016

(65) Prior Publication Data

US 2018/0073111 A1 Mar. 15, 2018

(30) Foreign Application Priority Data

Mar. 30, 2015 (JP) ..... 2015-069337

(51) Int. Cl.
*C22C 38/26* (2006.01)
*C22C 38/00* (2006.01)
(Continued)

(52) U.S. Cl.
CPC ..... *C22C 38/26* (2013.01); *C22C 38/001* (2013.01); *C22C 38/02* (2013.01); *C22C 38/04* (2013.01); *C22C 38/06* (2013.01); *C22C 38/24* (2013.01)

(58) Field of Classification Search
CPC ..... C22C 38/26; C22C 38/001; C22C 38/02; C22C 38/04; C22C 38/06; C22C 38/24
See application file for complete search history.

(56) References Cited

U.S. PATENT DOCUMENTS

2010/0186856 A1 7/2010 Williams et al.
2013/0273393 A1* 10/2013 Imataka ..... C21D 7/02 428/684

FOREIGN PATENT DOCUMENTS

CN 102405300 A 4/2012
CN 103180476 A 6/2013
(Continued)

OTHER PUBLICATIONS

International Search Report for PCT/JP2016/060524 dated Jun. 21, 2016.

(Continued)

*Primary Examiner* — Anthony J Zimmer
*Assistant Examiner* — Ricardo D Morales
(74) *Attorney, Agent, or Firm* — Birch, Stewart, Kolasch & Birch, LLP

(57) ABSTRACT

A cold forged part having a high cold forgeability and having a high endurance ratio due to work hardening by cold forging and age-hardening after cold forging, characterized by having a predetermined chemical composition, having an amount of solute Nb/amount of solute V of 0.03 or more and having a structure, by area ratio, of ferrite of 85% or more and a total of bainite and martensite of 5% or less.

1 Claim, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/24*** | (2006.01) |

(56) References Cited

FOREIGN PATENT DOCUMENTS

| | | | |
|---|---|---|---|
| JP | 2000-273580 | A | 10/2000 |
| JP | 2008-127596 | A | 6/2008 |
| JP | 2011-241441 | A | 12/2011 |
| JP | 2012-87361 | A | 5/2012 |
| JP | 2012-136730 | A | 7/2012 |
| WO | WO 2012/053541 | A1 | 4/2012 |

OTHER PUBLICATIONS

Written Opinion of the International Searching Authority for PCT/JP2016/060524 (PCT/ISA/237) dated Jun. 21, 2016.

* cited by examiner

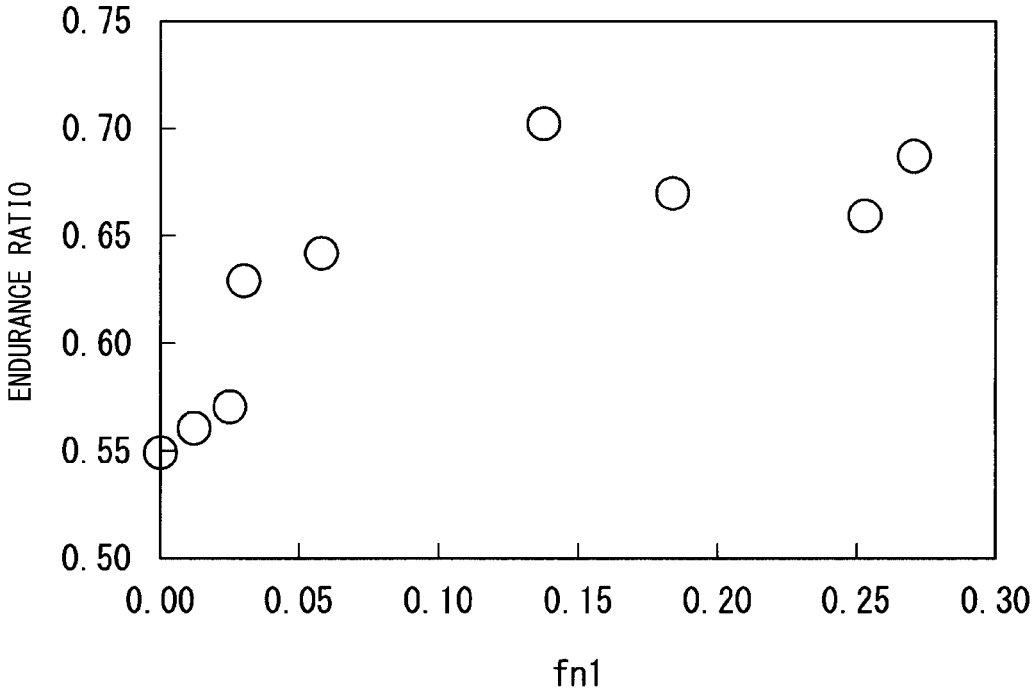
0.75
0.70
0.65
0.60
0.55
0.50
ENDURANCE RATIO
0.00
0.05
0.10
0.15
0.20
0.25
0.30
fn1

AGE-HARDENING STEEL FOR COLD FORGING USE

TECHNICAL FIELD

The present invention relates to age-hardening steel for cold forging use.

BACKGROUND ART

As structural steel used as a material for auto parts, industrial machinery parts, construction machinery parts, and other machine structural parts, carbon steel for machine structure use and alloy steel for machine structure use have been employed.

To produce parts from these steel materials, in the past, mainly the "hot forging-cutting" process was employed. In recent years, for the purpose of improving the productivity, a switch to the "cold forging-cutting" process has been underway. By employing the "cold forging-cutting" process in this way, a near net shape is achieved by cold forging and the amount of cutting of the material is slashed, so the productivity is improved.

However, in general, cold forging involves a large degree of working, so the problems arise that the working load is high, the tooling life is short, and parts easily crack. Therefore, improving the cold forgeability of the steel materials used as the starting materials, that is, reducing the load at the time of cold forging and suppressing cracking, has become the most important issue at hand.

On the other hand, auto parts, industrial machinery parts, construction machinery parts, and other machine structural parts are required to have high fatigue strength. To achieve high fatigue strength, it is effective to raise the hardness after cold forging. However, if raising the hardness of the starting material steel to try to raise the hardness after cold forging, the cold forgeability is caused to decrease. That is, in starting material steel, it was difficult to achieve both cold forgeability and fatigue strength.

Therefore, to solve such a problem, to raise the fatigue strength of a cold forged part, the practice has been to heat the part to the $Ac_3$ temperature or more after cold forging to quench and temper it or to heat treat it by induction hardening so as to thereby harden the entire part or its surface.

However, with such a method, the hardness of the part becomes higher after heat treatment, so there were the problems that decrease of the machinability was unavoidable and the merit of improvement of productivity due to the cold forging could not be enjoyed.

Therefore, there are so-called "age-hardening steel materials" which are used for applications for increasing hardness by heat treatment after machining without making the hardness unnecessarily high at the time of machining.

PLT 1 discloses art relating to steel for cold forging and nitridation, steel materials for cold forging and nitridation, and cold forged and nitride parts having as their chemical components, by mass %, C: 0.01 to 0.15%, Si: 0.05% or less, Mn: 0.10 to 0.90%, P: 0.030% or less, S: 0.030% or less, Cr: 0.50 to 2.0%, V: 0.10 to 0.50%, Al: 0.01 to 0.10%, N: 0.00080% or less, and O: 0.0030% or less and having a balance of Fe and impurities, satisfying $399\times C+26\times Si+123\times Mn+30\times Cr+32\times Mo+19\times V\leq 160$ or less, $20\leq(669.3\times\log C-1959.3\times\log N-6983.3)\times(0.067\times Mo+0.147\times V)\leq 80$, $160\leq 140\times Cr+125\times Al+235\times V$, and $90\leq 511\times C+33\times Mn+56\times Cu+15\times Ni+36\times Cr+5\times Mo+134\times V\leq 170$, having a microstructure of a ferrite-pearlite structure, a ferrite-bainite structure, or a ferrite-pearlite-bainite structure and having an area ratio of ferrite of 70% or more, having a content of V in the precipitates by analysis of extracted residue of 0.10% or less, having a core hardness of a Vickers hardness of 220 or more, and having an effective hardened layer depth of 0.20 mm or more.

PLT 2 discloses art relating to steel for cold heading use having as its chemical components, by mass %, C: 0.06 to 0.50%, Si: 0.05% or less, Mn: 0.5 to 1.0% or less, and V: 0.10 to 0.60%, having a total amount of pro-eutectoid ferrite and pearlite of an area ratio of 90% or more, having the pro-eutectic ferrite of an area % of at least an f-value shown by the formula $f=100-125[C]+22.5[V]$, and having an excellent cold workability and where VC precipitates in the pro-eutectoid ferrite.

CITATIONS LIST

Patent Literature

PLT 1: WO2012/053541A
PLT 2: Japanese Patent Publication No. 2000-273580A

SUMMARY OF INVENTION

Technical Problem

The art disclosed in PLT 1 provides steel and a steel material having excellent cold forgeability and machinability after cold forging and can give cold forged and nitrided parts a high core hardness, high surface hardness, and deep effective hardened layer depth. However, the fatigue strength is not alluded to and the improvement of the endurance ratio (fatigue strength/tensile strength) is not studied.

The art disclosed in PLT 2 relates to steel for cold heading use able to be provided for cold working as rolled and provides steel raised in cold forgeability by making VC precipitate during hot rolling and reducing the solute C. However, the art described in PLT 2 does not consider the fatigue strength. Further, when improving the strength, it is predicated on thermal refining. Cutting is required in the hardened state after thermal refining. A drop in the machinability is unavoidable.

The present invention was made in consideration of the above current state and has as its object to provide age-hardening steel for cold forging use securing a 400 MPa or more tensile strength and a 250 MPa or more fatigue strength while having a high cold forgeability and giving a high endurance ratio by work hardening due to cold forging and age-hardening after cold forging.

Solution to Problem

The inventors engaged in various studies to solve the above problem. As a result, the following matters (A) to (D) became clear.

(A) To obtain excellent cold forgeability, it is necessary to reduce the hardness of the material (steel) used for the forging. By reducing the hardness of the material, it is possible to decrease the forging load. Further, to keep down cracking at the time of cold forging, it is effective to reduce the amount of C in the steel used as the material.

(B) To obtain a high fatigue strength after age-hardening treatment, it is effective to utilize precipitation hardening by V carbonitrides and Nb carbonitrides and, further, to make the microstructure one mainly comprised of ferrite and pearlite and then reduce the pearlite area ratio. The age-hardening treatment has the action of not only raising the fatigue strength, but also raising the endurance ratio (fatigue strength/tensile strength). If the endurance ratio is high, the required fatigue strength is secured while the tensile strength can be made relatively low, so the effect is obtained that a drop in the machinability is prevented. In the present invention, a "high" endurance ratio means 0.600 or more.

(C) Even if Nb is contained alone, a sufficient effect of improvement of the endurance ratio cannot be obtained after age-hardening, but if simultaneously including Nb and V, a complex carbonitride precipitates whereby a larger effect of improvement of the endurance ratio can be obtained compared with steel containing Nb alone of course and even compared with steel containing V alone.

(D) Even if decreasing the amount of C so as to realize excellent cold forgeability, if suitably controlling the chemical composition of the steel used as the starting material, a sufficient aging precipitation is obtained and the endurance ratio of the steel is improved.

The present invention was completed based on the above discoveries (A) to (D) and has as its gist the following:

[1] Age-hardening steel for cold forging use, a chemical composition of the age-hardening steel consisting of, by mass %, C: 0.02 to 0.13%, Si: 0.01 to 0.50%, Mn: 0.20 to 0.70%, P: 0.020% or less (including 0%), S: 0.005 to 0.020%, Al: 0.005 to 0.050%, Cr: 0.02 to 1.50%, V: 0.02 to 0.50%, Nb: 0.005 to 0.050%, and N: 0.003 to 0.030% and a balance of Fe and unavoidable impurities, wherein a content of solute Nb (mass %) is 25% or more with respect to the total content of Nb, a content of solute V (mass %) is 50% or more with respect to the total content of V, fn1 expressed by the following formula (1) is 0.03 or more, fn2 expressed by the following formula (2) is 13.5 or less, and the metal structure contains, by area ratio, ferrite: 85% or more and total of bainite and martensite: 5% or less (including 0%):

$$fn1=[Nb]/[V] \quad (1)$$

$$fn2=125\times C-13\times V-4\times Nb \quad (2)$$

where in formula (1) and formula (2), [V] indicates the mass % of solute V, [Nb] indicates the mass % of solute Nb, C indicates the mass % of C which the steel contains, V indicates the mass % of V which the steel contains, and Nb indicates the mass % of Nb which the steel contains.

[2] The age-hardening steel for cold forging use of [1] wherein the chemical composition further contains, instead of a part of Fe, at least one element selected from Cu: 0.20% or less, Ni: 0.20% or less, and Mo: 0.20% or less.

Advantageous Effects of Invention

The age-hardening steel for cold forging use of the present invention is excellent in cold forgeability and enables a high endurance ratio and machinability to be secured by age-hardening treatment without heat treatment such as quenching and tempering or induction hardening. Furthermore, by using the age-hardening steel of the present invention as a starting material, instead of the conventionally general practice of the "hot forging-cutting" process, the "cold forging-age-hardening treatment-cutting" process can be used to produce auto parts, industrial machinery parts, construction machinery parts, and other machine structure parts and the productivity can be improved.

BRIEF DESCRIPTION OF DRAWINGS

FIG. 1 is a graph showing a relationship between fn1 calculated by the formula (1) and an endurance ratio (fatigue strength/tensile strength).

DESCRIPTION OF EMBODIMENTS

Below, the requirements of the age-hardening steel for cold forging use of the present invention (below, also referred to as the "steel" or "steel material") will be explained in detail. Note that, in the following explanation, the notations "%" of the contents of the different elements mean "mass %" unless otherwise specially indicated.

First, the chemical composition will be explained:

C: 0.02 to 0.13%

C is an element required for raising the strength as a machine structure part. However, in the present invention, the amount of C is decreased to keep down cracking at the time of cold forging. If the content of C exceeds 0.13%, cracks will form at the time of cold forging, so the content is made 0.13% or less. If the content of C is less than 0.02%, after age-hardening treatment, it is not possible to secure a 400 MPa or more tensile strength and a 250 MPa or more fatigue strength. For this reason, the content of C is made 0.02% or more. Note that, the content of C is preferably 0.03% to less than 0.10%.

Si: 0.01 to 0.50%

Si is an element required for deoxidation at the time of smelting. To obtain this effect, 0.01% or more is included. However, Si strengthens ferrite by solution strengthening, so if the content of Si exceeds 0.50%, the cold forgeability will be lowered. Therefore, the content of Si is made 0.50% or less. The content of Si is preferably made 0.05% to 0.45%.

Mn: 0.20 to 0.70%

Mn raises the strength of the final part as a solution strengthening element. If the content of Mn is less than 0.20%, the strength of the final part becomes insufficient, while if over 0.70%, the cold forgeability is lowered. For this reason, the content of Mn is made 0.20 to 0.70%. Note that, the content of Mn is preferably 0.25% to 0.65%.

P: 0.020% or Less

P is an impurity unavoidably contained in steel. It easily segregates in the steel and causes a local drop in ductility. If the content of P exceeds 0.020%, the local drop in ductility becomes remarkable. Therefore, the content is limited to 0.020% or less. The content is preferably limited to 0.018% or less. The content of P may also be 0.

S: 0.005 to 0.020%

S is an element improving the machinability. To obtain the effect of improving the machinability, 0.005% or more has to be contained. If over 0.020% is included, coarse sulfides are formed in the steel and become causes of cracking at the time of cold forging. Therefore, the content of S is made 0.005 to 0.020%. Note that, the content of S is preferably 0.018% or less.

Al: 0.005 to 0.050%

Al is a deoxidizing agent at the time of refining steel. To obtain the deoxidizing effect, 0.005% or more is included. If the content exceeds 0.050%, coarse Al inclusions are formed in the steel and cause cracking at the time of cold forging. Therefore, the content of Al is made 0.050% or less. Note that, the content of Al is preferably 0.045% or less.

Cr: 0.02 to 1.50%

Cr has the effect of raising the fatigue strength after forging as a solution strengthening element. However, if the content exceeds 1.50%, the hardness of the material is excessively raised and the cold forgeability falls. Therefore, the content of Cr is made 0.02 to 1.50%. Note that, the content of Cr is preferably 0.03% to 1.30%.

V: 0.02% to 0.50%

V forms complex carbonitrides of V and Nb at the time of age-hardening treatment to thereby raise the fatigue strength and endurance ratio. To obtain this effect, V is included in an amount of 0.02% or more. From the viewpoint of the alloy cost, the upper limit is made 0.50%. Note that, the content of V is preferably 0.03% or more.

Nb: 0.005% to 0.050%

Nb, by simultaneous addition with V, complexly forms a carbonitride with V at the time of age-hardening treatment to thereby raise the endurance ratio. To obtain this effect, 0.005% or more is included. From the viewpoint of the alloy cost, the upper limit is made 0.050%. Note that, the content of Nb is preferably 0.010% or more.

N: 0.003 to 0.030%

N bonds with V and Nb in the age-hardening treatment after cold forging and precipitates as complex carbonitrides to improve the endurance ratio. To obtain this effect, 0.003% or more is included. However, if excessively included, this becomes a cause of a drop in the cold forgeability, so the content is made 0.030% or less. Note that, the content of N is preferably 0.025% or less.

The chemical composition of the age-hardening steel for cold forging use of the present invention includes a balance of Fe and unavoidable impurities in addition to the above elements. The "unavoidable impurities" mean impurities entering from the starting materials of mineral ores and scraps or from the manufacturing environment etc. when industrially producing ferrous metal materials.

The chemical composition of the age-hardening steel for cold forging use of the present invention may also contain, in addition to the above elements, one or more types of elements of Cu, Ni, and Mo in place of part of the Fe.

Below, the actions and effects of the optional elements of Cu, Ni, and Mo and the reasons for limitation of their contents will be explained.

Cu: 0.20% or Less

Cu has the effect of raising the fatigue strength of steel, so 0.20% or less may be included. If exceeding 0.20%, the cold forgeability falls. From the viewpoint of securing the cold forgeability, the amount of Cu when included is preferably made 0.15% or less.

Ni: 0.20% or Less

Ni has the effect of raising the fatigue strength of steel, so 0.20% or less may be included. If exceeding 0.20%, the cold forgeability falls. From the viewpoint of securing the cold forgeability, the amount of Ni when included is preferably made 0.15% or less.

Mo: 0.20% or Less

Mo has the effect of raising the fatigue strength of steel, so 0.20% or less may be included. If exceeding 0.20%, the cold forgeability falls. From the viewpoint of securing the cold forgeability, the amount of Mo when included is preferably made 0.15% or less.

The content (mass %) of the solute Nb has to be 25% or more with respect to the total content of the Nb, while the content (mass %) of the solute V has to be 50% or more with respect to the total content of V.

The "amount of solute V" means the mass % of V not precipitating as a carbonitride in the V contained in the steel, while the "amount of solute Nb" means the mass % of Nb not precipitating as a carbonitride in the Nb contained in the steel material.

As explained above, by simultaneously adding Nb and V to the steel, it is possible to complexly form carbonitrides with V at the time of age-hardening treatment and raise the endurance ratio. To complexly form carbonitrides with V at the time of age-hardening treatment, it is necessary that there be suitable amounts of solute Nb and solute V in the steel before the age-hardening treatment.

Specifically, the components of the age-hardening steel for cold forging use of the present invention have to be ones whereby the fn1 defined by the formula (1) becomes 0.03 or more. This is so as to obtain a suitable amount of complex carbonitrides of Nb and V for raising the endurance ratio at the time of age-hardening treatment. Note that, the upper limit value of fn1 is not particularly limited, but may be made 0.90 or less.

$$fn1=[Nb]/[V] \quad (1)$$

where, [V] indicates the mass % of the solute V, and [Nb] indicates the mass % of the solute Nb.

The amount of solute V and amount of solute Nb are found by for example the following extracted residue analysis method.

From the position of the radius of age-hardening steel formed into a round bar×0.5, a 10 mm×10 mm×10 mm sample is cut out and used as the sample for extracted residue analysis. This sample is electrolyzed by a constant current in a 10% AA-based solution (liquid comprised of tetramethyl ammonium chloride, acetyl acetone, and methanol mixed in a 1:10:100 ratio).

At that time, to remove the deposits on the surface, first, preliminary electrolysis is performed under conditions of a current of 1000 mA and a time of 28 minutes, then the deposits on the sample surface are removed from the sample in alcohol by ultrasonic cleaning, the mass of the sample after removal of the deposits is measured, and that value is used as the mass of the sample before the electrolysis performed next.

Next, the sample is electrolyzed under conditions of a current of 173 mA, a time of 142 minutes, and room temperature. The electrolyzed sample is taken out and the deposit (residue) on the sample surface is removed from the sample in alcohol by ultrasonic cleaning. After that, the solution after electrolysis and the solution used for the ultrasonic cleaning are suction filtered by a mesh size 0.2 μm filter to obtain the residue. The mass of the sample after removal of the deposits (residue) is measured and the difference in the measurement values of the mass of the sample before and after electrolysis is used as the "mass of the electrolyzed sample".

The residue obtained on the filter is transferred to a Petri dish, made to dry, and measured for mass, then is analyzed based on JIS G 1258 by an ICP emission spectrophotometric analyzer (inductively coupled plasma emission spectrophotometric analyzer) to find the "mass of V and Nb in the residue".

Further, the "mass of V and Nb in the residue" found in the above way is divided by the "mass of the electrolyzed sample" and shown as a percentage. This is the "amount of solute V and amount of solute Nb according to analysis of the extracted residue".

The grounds for the derivation of the above-mentioned formula (1) relating to the fn1 will be explained.

The inventors ran tests on steels containing C: 0.02 to 0.13%, Si: 0.01 to 0.50%, Mn: 0.20 to 0.70%, P: 0.020% or less (including 0%), S: 0.005 to 0.020%, Al: 0.005 to 0.050%, Cr: 0.02 to 1.50%, V: 0.02 to 0.50%, Nb: 0.005 to 0.050%, and N: 0.003 to 0.030% and having a balance of Fe and unavoidable impurities in which they held them at the A3 point or less for 30 min to 60 min to prepare test steels having various amounts of solute V and amounts of solute Nb. Further, they used the above methods to measure the amounts of solute V and amounts of solute Nb and ran tensile tests (based on JIS Z 2241) and Ono-type rotating bending fatigue tests (based on JIS Z 2274) on the above test steels to find the endurance ratios.

From the obtained results, the ratio of the amount of solute Nb with respect to the amount of solute V of the test steel was found and the relationship with the endurance ratio was investigated. The results are shown in FIG. 1.

From FIG. 1, it became clear that by making the ratio of the amount of solute Nb with respect to the amount of solute V of the test steel a value of 0.03 or more, it is possible to make the endurance ratio 0.60 or more. If the value of fn1 defined by formula (1) is less than 0.03, no complex carbonitrides precipitate, so the effect of improvement of the endurance ratio cannot be obtained. For this reason, the value of fn1 is limited to 0.03 or more.

The microstructure of the age-hardening steel for cold forging use of the present invention is mainly a mixed structure of ferrite and pearlite where the area ratio of ferrite is made 85% or more. The area ratio of pearlite may be small and may also be 0. Note that, as structures other than ferrite and pearlite (remaining structures), bainite and martensite are sometimes produced, but in such a case, the total area ratio of the bainite and martensite must be limited to 5% or less.

Further, the age-hardening steel for cold forging use of the present invention must have an fn2 defined by formula (2) of 13.5 or less. Note that, the lower the fn2 value, the more desirable. The lower limit value is not particularly defined, but from the upper and lower limit values of the contents of the different elements becomes 0.80 or more.

$$fn2=125\times C-13\times V-4\times Nb \quad (2)$$

where, "C" indicates the mass % of C which the steel contains, "V" indicates the mass % of V which the steel contains, and "Nb" indicates the mass % of Nb which the steel contains.

The grounds for derivation of the above formula (2) relating to fn2 will be explained.

To improve the endurance ratio, the area ratio of ferrite has to be made 85% or more. Further, it is important to strengthen the ferrite. V and Nb are elements which precipitate as carbonitrides during age-hardening treatment and strengthen ferrite. If the value of fn2 defined in formula (2) is 13.6 or more, the ferrite will not be sufficiently strengthened. Further, sometimes the ferrite area ratio will not become 85% or more. For this reason, it is not possible to obtain an endurance ratio of 0.60 or more. For this reason, to obtain the endurance ratio sought in the present invention, fn2 is made 13.5 or less.

Bainite structures and martensite structures are structures inferior in cold deformation ability compared with ferrite and pearlite structures and become causes of cracking at the time of cold forging. Accordingly, the bainite structures and martensite structures must be restricted to a total area ratio of 5% or less. From the viewpoint of suppressing cracking at the time of cold forging, the amounts of the bainite structures and martensite structures produced may also be 0.

Next, the method of production of the age-hardening steel for cold forging use of the present invention will be explained.

To obtain the age-hardening steel for cold forging use of the present invention, for example, it is sufficient to prepare a cast slab or steel slab having the above-mentioned chemical composition as a rolling material, roll it by hot rolling, then cool it down to room temperature after finishing the rolling in the final rolling process.

The method of obtaining the cast slab or steel slab is not particularly limited. An ordinary method may be used. The hot rolling has to be performed with the rolling temperature at the final rolling process made 900° C. or more so as to obtain the fn1 value ([Nb]/[V]) prescribed in formula (1).

Further, when cooling down to room temperature after the end of hot rolling, to obtain the above prescribed microstructure, it is necessary to use a method not using a large cooling rate giving rise to martensite and bainite, for example, natural cooling. More specifically, the average cooling rate has to be made 0.6° C./s or less.

Regarding Age-Hardening Treatment

The age-hardening steel of the present invention can for example be used for producing a machine structure part. When producing a machine structure part, the age-hardening steel of the present invention is cold forged, treated for age-hardening, then sent on to a cutting or other working process.

To keep hardening from occurring after age-hardening treatment after cold forging as much as possible while obtaining a part having a high fatigue strength, it is sufficient to perform the cold forging for obtaining the desired part shape, then for example reheat the part at a temperature region of 200° C. to the Ac3 point for 30 min or more (age-hardening treatment).

If the heating temperature is less than 200° C., no precipitation of carbonitrides occurs, so a high endurance ratio is liable to be unable to be obtained. Further, if heating to over the Ac3 point, not only does coarsening of the precipitate make it impossible to obtain a high endurance ratio, but also the structure transforms to austenite, so heat treatment strain is unavoidable.

If the heating time is less than 30 min, carbonitrides will not precipitate and a high endurance ratio is liable to be unable to be obtained. Further, even if the heating time is long, a similar effect is obtained, but if too long, the production costs are raised, so preferably the time is 180 min or less.

Note that, the Ac3 point can be calculated by the following formula:

$$Ac3(^\circ C.)=-230.5\times C+31.6\times Si-20.4\times Mn-39.8\times Cu-18.1\times Ni-14.8\times Cr+16.8\times Mo+912$$

The symbols of the elements in the formula show the contents (mass %) of the elements in the steel.

Above, age-hardening steel according to the present invention was explained. The shape of the age-hardening steel of the present invention is not an issue. The invention can be applied to steel plate, steel tubes, long products (steel shapes, steel bars, wires, rails, etc.), and any other shapes.

EXAMPLES

Below, examples will be used to explain the present invention in further detail. The following examples specifically show illustrations of the present invention. The present invention is not limited to the conditions used in the following examples however. Note that, in the tables, underlined values show values outside the scope of the present invention.

Each of the Steels A to P having the chemical compositions shown in Table 1 was formed into a 150 kg ingot by vacuum melting, then heated at 1200° C., then finished at 1000° C. to cog it (hot forge it) into a ϕ2 steel round bar which was then cooled in the atmosphere. Note that, the later explained Test No. 17 heated the steel to 1050° C. to start cogging and finished it at 780° C.

Among the above Steels A to P, the Steels A to J are steels with chemical compositions within the range prescribed in the present invention. On the other hand, the Steels K to P are steels of comparative examples with chemical compositions outside the range prescribed in the present invention.

Table 2 shows the hardness, microstructure, amount of solute V, amount of solute Nb, fn1, and fn2 of the steel after hot forging. In the "microstructure" of Table 2, "F" shows ferrite, "P" pearlite, "B" bainite, and "M" martensite. Further, the "B, M area ratio" in Table 2 shows the total area ratio of bainite and martensite.

TABLE 1

| | | Chemical composition (mass %) Balance: Fe and impurities | | | | | | | | | | | | | Ac3 |
|---|---|---|---|---|---|---|---|---|---|---|---|---|---|---|---|
| Class | Steel | C | Si | Mn | P | S | Al | Cr | V | Nb | N | Cu | Ni | Mo | (° C.) |
| Ex. | A | 0.07 | 0.19 | 0.36 | 0.014 | 0.005 | 0.030 | 0.07 | 0.18 | 0.025 | 0.005 | 0.00 | 0.00 | 0.00 | 893 |
| | B | 0.13 | 0.05 | 0.40 | 0.008 | 0.009 | 0.031 | 1.10 | 0.20 | 0.040 | 0.005 | 0.00 | 0.00 | 0.00 | 866 |
| | C | 0.02 | 0.03 | 0.42 | 0.009 | 0.018 | 0.024 | 0.11 | 0.10 | 0.010 | 0.004 | 0.00 | 0.00 | 0.10 | 898 |
| | D | 0.06 | 0.04 | 0.47 | 0.009 | 0.010 | 0.027 | 0.23 | 0.50 | 0.020 | 0.004 | 0.00 | 0.00 | 0.00 | 886 |
| | E | 0.11 | 0.10 | 0.43 | 0.008 | 0.010 | 0.025 | 0.07 | 0.02 | 0.036 | 0.010 | 0.00 | 0.00 | 0.00 | 880 |
| | F | 0.05 | 0.06 | 0.41 | 0.010 | 0.009 | 0.030 | 0.08 | 0.23 | 0.050 | 0.005 | 0.00 | 0.00 | 0.01 | 893 |
| | G | 0.10 | 0.06 | 0.32 | 0.008 | 0.007 | 0.019 | 0.09 | 0.16 | 0.005 | 0.004 | 0.06 | 0.08 | 0.00 | 883 |
| | H | 0.09 | 0.40 | 0.32 | 0.008 | 0.007 | 0.019 | 0.09 | 0.16 | 0.030 | 0.004 | 0.00 | 0.01 | 0.00 | 896 |
| | I | 0.04 | 0.25 | 0.38 | 0.009 | 0.010 | 0.025 | 0.21 | 0.09 | 0.020 | 0.004 | 0.00 | 0.00 | 0.00 | 900 |
| | J | 0.03 | 0.35 | 0.55 | 0.008 | 0.007 | 0.019 | 0.09 | 0.18 | 0.028 | 0.004 | 0.00 | 0.00 | 0.00 | 904 |
| Comp. | K | 0.24 | 0.22 | 0.56 | 0.012 | 0.006 | 0.036 | 0.06 | 0.08 | 0.010 | 0.004 | 0.00 | 0.00 | 0.00 | 851 |
| ex. | L | 0.01 | 0.03 | 0.37 | 0.008 | 0.018 | 0.043 | 0.06 | 0.06 | 0.009 | 0.005 | 0.00 | 0.00 | 0.00 | 902 |
| | M | 0.11 | 0.20 | 0.69 | 0.017 | 0.020 | 0.011 | 0.08 | 0.00 | 0.020 | 0.017 | 0.00 | 0.00 | 0.00 | 878 |
| | N | 0.13 | 0.21 | 0.37 | 0.008 | 0.018 | 0.043 | 0.06 | 0.01 | 0.010 | 0.005 | 0.00 | 0.00 | 0.00 | 880 |
| | O | 0.06 | 0.10 | 0.66 | 0.009 | 0.010 | 0.025 | 0.21 | 0.20 | 0.000 | 0.004 | 0.00 | 0.00 | 0.00 | 885 |
| | P | 0.07 | 0.20 | 0.50 | 0.010 | 0.009 | 0.030 | 0.50 | 0.15 | 0.003 | 0.002 | 0.00 | 0.00 | 0.00 | 885 |

TABLE 2

| | | | Hot forging | | After hot forging | | | | | | | | | |
|---|---|---|---|---|---|---|---|---|---|---|---|---|---|---|
| Class | Test no. | Steel | Heating temp. (° C.) | Finishing temp. (° C.) | Hardness (Hv) | F area rate (%) | P area rate (%) | B, M area rate (%) | [V] | [Nb] | [V]/V | [Nb]/Nb | fn1 | fn2 |
| Ex. | 1 | A | 1200 | 1000 | 114 | 94 | 6 | 0 | 0.135 | 0.012 | 0.75 | 0.48 | 0.09 | 6.3 |
| | 2 | B | 1200 | 1000 | 156 | 87 | 9 | 4 | 0.152 | 0.012 | 0.76 | 0.30 | 0.08 | 13.5 |
| | 3 | C | 1200 | 1000 | 84 | 98 | 2 | 0 | 0.080 | 0.007 | 0.80 | 0.70 | 0.09 | 1.2 |
| | 4 | D | 1200 | 1000 | 163 | 96 | 4 | 0 | 0.320 | 0.010 | 0.64 | 0.50 | 0.03 | 0.9 |
| | 5 | E | 1200 | 1000 | 109 | 88 | 12 | 0 | 0.010 | 0.012 | 0.50 | 0.33 | 1.20 | 13.3 |
| | 6 | F | 1200 | 1000 | 107 | 95 | 5 | 0 | 0.150 | 0.024 | 0.65 | 0.48 | 0.16 | 3.1 |
| | 7 | G | 1200 | 1000 | 105 | 91 | 9 | 0 | 0.098 | 0.003 | 0.61 | 0.60 | 0.03 | 10.4 |
| | 8 | H | 1200 | 1000 | 120 | 92 | 8 | 0 | 0.106 | 0.016 | 0.66 | 0.53 | 0.15 | 9.1 |
| | 9 | I | 1200 | 1000 | 101 | 96 | 4 | 0 | 0.063 | 0.012 | 0.70 | 0.60 | 0.19 | 3.8 |
| | 10 | J | 1200 | 1000 | 103 | 97 | 3 | 0 | 0.130 | 0.018 | 0.72 | 0.64 | 0.14 | 1.3 |
| Comp. | 11 | K | 1200 | 1000 | 187 | 70 | 30 | 0 | 0.050 | 0.004 | 0.63 | 0.40 | 0.08 | 28.9 |
| ex. | 12 | L | 1200 | 1000 | 74 | 98 | 2 | 0 | 0.048 | 0.006 | 0.80 | 0.67 | 0.13 | 0.4 |
| | 13 | M | 1200 | 1000 | 100 | 80 | 20 | 0 | 0.000 | 0.011 | — | 0.55 | ∞ | 13.7 |
| | 14 | N | 1200 | 1000 | 111 | 84 | 16 | 0 | 0.005 | 0.004 | 0.50 | 0.40 | 0.80 | 16.1 |
| | 15 | O | 1200 | 1000 | 99 | 94 | 6 | 0 | 0.126 | 0.000 | 0.63 | — | 0.00 | 4.9 |
| | 16 | P | 1200 | 1000 | 103 | 92 | 8 | 0 | 0.090 | 0.001 | 0.60 | 0.33 | 0.01 | 6.8 |
| | 17 | A | 1050 | 780 | 170 | 93 | 7 | 0 | 0.054 | 0.002 | 0.30 | 0.08 | 0.04 | 6.3 |

From the above round bar forged material, a ϕ14×21 mm (where ϕ indicates the diameter, same below) columnar test piece was cut out. This was subjected to a compression test by a cold press to evaluate the cold forgeability.

The evaluation items were made the presence of cracks when the working rate ((1-height after working/height before working)×100) is 70% (cracks at time of 70% working) and forging load at the time of a working rate of 50% (load at the time of 50% working (ton)). The presence of cracks was determined by examination using a 5× magnifying glass. If no cracks of a length of 0.5 mm or more could be observed in five test pieces, it was judged there were no cracks. For the forging load, 20 tons or less was judged sufficiently low and good.

Furthermore, the above ϕ42 mm round bar forged material was buried in resin, then polished so as to observe its horizontal cross-section and was corroded with Nital to observe its microstructure. The Vickers hardness was measured with a load of 9.8N. The microstructure was observed and the Vickers hardness was measured near the center of the round bar forged material in each case. The Vickers hardness was measured at three points and the average used as the measurement value.

Next, the above round bar forged material was peeled to ϕ36 mm, drawn to ϕ18 mm simulating 75% cold forging, heated to 600° C. and held there for 60 min (age-hardening treatment), then cooled in the atmosphere. Test pieces for tensile tests and Ono-type rotating bending fatigue tests were taken and used for the respective tests.

Furthermore, from the above ϕ42 mm round bar forged material, a 10 $mm^3$ extracted residue test piece was cut out and measured for the amount of solute V and the amount of solute Nb by the above extracted residue analysis method.

Table 3 shows the presence of any cracks at the time of a working rate of 70%, the forging load at the time of a working rate of 50%, and the tensile strength, fatigue strength, and endurance ratio (fatigue strength/tensile strength) after drawing to ϕ18 mm, then holding at 600° C. for 60 min in the evaluation of cold forgeability of Test Nos. 1 to 17 using the Steel Materials A to Q. An endurance ratio of 0.600 or more is judged as good, while a tensile strength of 400 MPa or more and a fatigue strength of 250 MPa or more are judged as good. The underlines in Table 3 mean not judged good.

Note that, samples in which all of the endurance ratio, fatigue strength, and forging load at the time of 50% working were excellent were judged as good in "cold forgeability×fatigue strength" and evaluated as able to enjoy the effect of the present invention.

ratio of ferrite is low and further the value of fn2 exceeds the value prescribed in the present invention, so the endurance ratio sought is not obtained.

In the case of Test No. 12, the content of C is below the range prescribed in the present invention, so while the forgeability at the time of cold forging is satisfactory, the tensile strength and fatigue strength after age-hardening treatment are low, so the performance sought is not obtained.

In the case of Test No. 13, V is not added, so the ferrite is not reinforced. Further, the area ratio of ferrite is low and, further, the value of fn2 is above the value prescribed in the present invention, so the endurance ratio sought is not obtained.

In the case of Test No. 14, the amount of addition of V is below the range prescribed in the present invention, so the ferrite is not sufficiently reinforced and, further, the area ratio of ferrite is low and the value of fn2 is above the value prescribed in the present invention, so the endurance ratio sought is not obtained.

In the case of Test No. 15, Nb is not added, so the ferrite is not sufficiently strengthened and the endurance ratio sought is not obtained.

TABLE 3

| | | | Cold forgeability | | | | | | |
|---|---|---|---|---|---|---|---|---|---|
| | | | | Load at | Held at 600° C. for 60 min after drawing | | | | Cold |
| Class | Test no. | Steel | Cracks at time of working 70% | time of working 50% (ton) | Hardness (Hv) | Tensile strength (MPa) | Fatigue strength (MPa) | Endurance ratio | forgeability × fatigue strength |
| Ex. | 1 | A | None | 12.5 | 189 | 586 | 390 | 0.666 | Good |
| | 2 | B | None | 17.2 | 254 | 813 | 600 | 0.738 | Good |
| | 3 | C | None | 9.2 | 132 | 407 | 290 | 0.713 | Good |
| | 4 | D | None | 17.9 | 268 | 871 | 580 | 0.666 | Good |
| | 5 | E | None | 12.0 | 151 | 423 | 270 | 0.638 | Good |
| | 6 | F | None | 11.8 | 198 | 614 | 420 | 0.684 | Good |
| | 7 | G | None | 11.6 | 200 | 624 | 410 | 0.657 | Good |
| | 8 | H | None | 13.2 | 213 | 667 | 440 | 0.660 | Good |
| | 9 | I | None | 11.1 | 163 | 505 | 330 | 0.653 | Good |
| | 10 | J | None | 11.3 | 185 | 579 | 380 | 0.656 | Good |
| Comp. | 11 | K | Yes | 24.3 | 223 | 669 | 400 | 0.598 | Poor |
| ex. | 12 | L | None | 8.1 | 94 | 310 | 200 | 0.645 | Poor |
| | 13 | M | None | 11.0 | 110 | 374 | 200 | 0.535 | Poor |
| | 14 | N | None | 12.2 | 123 | 498 | 270 | 0.542 | Poor |
| | 15 | O | None | 10.9 | 164 | 525 | 300 | 0.571 | Poor |
| | 16 | P | None | 11.3 | 160 | 512 | 300 | 0.586 | Poor |
| | 17 | A | None | 19.1 | 160 | 500 | 280 | 0.560 | Poor |

From Table 3, in the case of the steel bars of Test Nos. 1 to 10 satisfying the conditions of the chemical composition and microstructure prescribed in the present invention, the "cold forgeability×fatigue strength" was evaluated as "good", that is, there were no cracks at the targeted 70% working, the forging load at 50% working was 20 tons or less, and the desired cold forgeability was obtained. Further, due to the age-hardening treatment after forging, the endurance ratio became 0.60 or more, the hardness was kept down, and a high fatigue strength was obtained.

As opposed to this, in the case of the steel bars of Test Nos. 11 to 17 off from at least one of the conditions of the chemical composition and microstructure prescribed in the present invention, the "cold forgeability×fatigue strength" was evaluated as "poor" and the desired cold forgeability or fatigue strength could not be obtained.

In the case of Test No. 11, the content of C exceeds the range prescribed in the present invention, so the load at the time of cold forging is high, cracks are also observed, and the cold forgeability sought is not obtained. Further, the area In the case of Test No. 16, the amount of addition of Nb is below the range prescribed in the present invention, so the ferrite is not strengthened and also the value of fn1 is above the value prescribed in the present invention, so the endurance ratio sought is not obtained.

In the case of Test No. 17, the content of the solute Nb and the content of the solute V are below the values prescribed in the present invention, so the ferrite is not sufficiently strengthened and the endurance ratio sought is not obtained.

INDUSTRIAL APPLICABILITY

The age-hardening steel for cold forging use of the present invention enables a high fatigue strength to be secured and is excellent in cold forgeability, so can contribute to realization of near net shapes in parts which have previously been manufactured by a "hot forging-cutting" process such as auto parts, industrial machinery parts, construction machinery parts, and other machine structure parts.

The invention claimed is:

1. Age-hardening steel for cold forging use, a chemical composition of the age-hardening steel consisting of, by mass %, C: 0.02 to 0.13%,
Si: 0.01 to 0.50%,
Mn: 0.20 to 0.70%,
P: 0.020% or less (including 0%),
S: 0.005 to 0.020%,
Al: 0.005 to 0.050%,
Cr: 0.02 to 1.50%,
V: 0.02 to 0.50%,
Nb: 0.005 to 0.050%,
Cu: 0.20% or less,
Ni: 0.20% or less,
Mo: 0.20% or less,
N: 0.003 to 0.030% and
a balance of Fe and unavoidable impurities,
wherein
a content of solute Nb (mass %) is 25% or more with respect to the total content of Nb,
a content of solute V (mass %) is 50% or more with respect to the total content of V,
fn1 expressed by the following formula (1) is 0.03 or more,
fn2 expressed by the following formula (2) is 13.5 or less, and
the metal structure contains, by area ratio,
ferrite: 85% or more and
a total of bainite and martensite: 5% or less (including 0%):

$$fn1=[Nb]/[V] \quad (1)$$

$$fn2=125\times C-13\times V-4\times Nb \quad (2)$$

where in formula (1) and formula (2), [V] indicates the mass % of solute V, [Nb] indicates the mass % of solute Nb, C indicates the mass % of C which the steel contains, V indicates the mass % of V which the steel contains, and Nb indicates the mass % of Nb which the steel contains.

* * * * *